US005674552A

United States Patent [19]

Ohira et al.

[11] Patent Number: 5,674,552

[45] Date of Patent: Oct. 7, 1997

[54] METHOD OF AND APPARATUS FOR POSITIONING A CYLINDRICAL BASE MATERIAL

[75] Inventors: Akira Ohira; Junji Ujihara; Eiichi Kijima, all of Hachioji, Japan

[73] Assignee: Konica Corporation, Tokyo, Japan

[21] Appl. No.: 651,913

[22] Filed: May 21, 1996

[30] Foreign Application Priority Data

May 24, 1995 [JP] Japan ..... 7-125231
May 24, 1995 [JP] Japan ..... 7-125232

[51] Int. Cl.[6] ..... B05D 1/26; B05D 3/04; B05C 5/02; B05C 13/00

[52] U.S. Cl. ..... 427/8; 427/299; 427/300; 427/434.7; 118/712; 118/62; 118/68; 118/72; 118/405; 118/DIG. 11

[58] Field of Search ..... 427/299, 300, 427/434.7, 8; 118/712, 62, 68, 72, 404, 405, DIG. 11; 406/87, 88, 194; 414/745.2

[56] References Cited

U.S. PATENT DOCUMENTS 5,198,028 3/1993 Nakano et al. ..... 118/DIG. 11

*Primary Examiner*—Katherine A. Bareford
*Attorney, Agent, or Firm*—Frishauf, Holtz, Goodman, Langer & Chick, P.C.

[57] ABSTRACT

In a method of coating outer surfaces of plural cylinders by a coater having a circular hole on which a coating surface is provided, gas is blown onto the outer surface of the cylinder by a cylindrical blowing device so that the cylinder is positioned coaxially with the circular hole. The gas amount is changed when the cylindrical blowing device blows gas onto a joint portion at which a bottom edge of an upper cylinder contacts with a top edge of a lower cylinder.

20 Claims, 15 Drawing Sheets

$$C = (D - d) / L$$

METHOD OF AND APPARATUS FOR POSITIONING A CYLINDRICAL BASE MATERIAL

BACKGROUND OF THE INVENTION

The present invention relates to a method and an apparatus for positioning a cylindrical base material when a processing solution is continuously coated on the outer peripheral surfaces of a plurality of cylindrical base materials or cylinders. Specifically, the present invention relates to a method and an apparatus for accurately positioning the cylindrical base material when an electrophotographic photoreceptor is produced by coating a photosensitive solution on the cylindrical base material.

When an organic photoconductive photoreceptor drum, which is a photoreceptor for use in an electrophotographic apparatus, is produced, a photosensitive solution (processing solution) is coated onto the cylindrical drum. When the photosensitive solution is coated on the drum, slide hoppers are positioned at predetermined positions on the peripheral surface of the cylindrical drum. In this case, an adjustment operation is required so that a constant gap between the photoreceptor drum and the hopper is maintained with respect to the peripheral surface. In this case, since the required thickness of a coating layer is extremely thin, the film thickness of the coating film layer deviates greatly on the entire cylindrical surface with respect to the peripheral direction even when the position of the cylindrical drum is deviated only 0.1 mm, resulting in a large deviation factor.

When such film thickness deviation of the coating film layer occurs, disadvantages such as changes of charged amount, nonuniform sensitivity, or changes of the residual potential voltage, etc., are caused, as is obvious to skilled persons. Accordingly, accurate positioning of the cylindrical drum is an extremely important matter.

Conventionally, as a positioning apparatus of such cylindrical drums, there is an apparatus, for example, disclosed in Japanese Patent Publication Open to Public Inspection No. 50537/1985, in which a position regulation roller, rotatably provided on a supporting member, is provided so as to contact the outer periphery of the cylindrical drum. Further, a positioning apparatus for the photoreceptor drum, using an air bearing, is disclosed in Japanese Patent Publication Open to Public Inspection Nos. 280063/1991 and 73655/1992.

However, the conventional roller-contact type positioning apparatus has a disadvantage in which the cylindrical drum is damaged because the position regulation roller directly contacts the cylindrical drum during positioning. When the cylindrical drum is damaged, electrophotographic characteristics are lowered, which is obvious to skilled persons.

In the bearing-type positioning apparatus, the position is carried out by forcing a fluid such as air or like, from a jet-nozzle, so that damage to the cylindrical drum can be prevented, which is very advantageous.

However, as shown in FIG. 16(*a*), in cases where a plurality of cylindrical drums are moved under the condition that end portions of a plurality of cylindrical drums 1A, 1B contact each other, one cylindrical drum is stacked on the other, and the end of one drum is connected to the end of another drum, when the cylindrical drum 1A is shifted from the position of the positioning jet nozzle 3 and the next cylindrical drum 1B is located in position of the nozzle, there is the possibility that the prior cylindrical drum 1A is horizontally moved by the external force due to the external factors. In such cases, there is the possibility that the prior cylindrical drum 1A is quickly horizontally deviated from the predetermined position, even when the next cylindrical drum 1B can be positioned at its predetermined position as shown in FIG. 16(*b*). When such a movement occurs, cross lines or photoreceptor coating solution deficiency is caused in the photoreceptor solution.

SUMMARY OF THE INVENTION

A major object of the present invention is to position the cylindrical drum without damage to the cylindrical drum itself; and further to prevent position deviation of the cylindrical drum in the connecting portion between adjacent cylindrical drums.

In order to attain the above object, a method for positioning cylindrical base members of the present invention is characterized in that: cylindrical axes of a plurality of cylindrical base materials are aligned with each other, and one of the cylindrical base materials is stacked on the following cylindrical base materials; a coating solution is continuously coated on the outer peripheral surfaces of the cylindrical base material by a vertical coating apparatus while stacked cylindrical base materials are vertically pushed upward; and the cylindrical base material is positioned by a positioning means in which a hollow-cylindrical jetting means, having a jet opening to jet a fluid on the outer peripheral surface of the cylindrical base material, is coaxially provided with the cylindrical base material at a position before or after coating; wherein the amount of the fluid forced from the jet opening is controlled at the connected portion at which end surfaces of the cylindrical base materials contact with each other.

A detecting means is provided to detect the connected portion at which end surfaces of adjacent cylindrical base materials are in contact with each other, and the amount of the fluid forced from the jet opening is controlled so as to be changed according to detection signals detected by the detecting means when the connected portion of the cylindrical base materials passes the jet openings.

The amount of fluid ejected from the jet openings is controlled so as to be changed according to timing signals detected by a timer means when the connected portion, at which end surfaces of the cylindrical base materials are in contact with each other, of the cylindrical base materials passes the jet openings.

The pressure of the fluid ejected from the jet opening is changed at the connected portion at which the end surfaces of adjacent cylindrical base materials are in contact with each other.

A detecting means is provided to detect the connected portion at which end surfaces of adjacent cylindrical base materials are in contact with each other, and pressure of the fluid ejected from the jet opening is controlled so as to be changed according to detection signals detected by the detecting means when the connected portion of the cylindrical base materials passes the jet openings.

The pressure of the fluid ejected from the jet opening is controlled so as to be changed according to detection signals detected by a timer means, and clock signals, when the connected portion, at which end surfaces of adjacent cylindrical base materials are in contact with each other, of the cylindrical base materials passes the jet openings.

Cylindrical axes of a plurality of cylindrical base materials are aligned with each other, and one of the cylindrical base materials is stacked on the other cylindrical base materials; a coating solution is continuously coated on the outer peripheral surfaces of the cylindrical base materials by a vertical coating apparatus while stacked cylindrical base materials are pushed vertically upward; and the cylindrical base material is positioned by a positioning means in which a hollow-cylindrical jetting means, having a jet opening to eject a fluid on the outer peripheral surface of the cylindrical base material, is coaxially provided with the cylindrical base material at positions before or after coating, wherein a detecting means is provided to detect the connected portion at which end surfaces of the cylindrical base materials are in contact with each other, and the amount of the fluid ejected from the jet opening is controlled so as to be changed according to the detection signals detected by the detecting means when the connected portion of the cylindrical base materials passes the jet openings.

In the present invention, a fluid is ejected onto the outer peripheral surface of the cylindrical base material, and the cylindrical base material is positioned by the pressure of the ejected fluid. That is, when a fluid, for example air, is ejected from the circumference of the cylindrical base material, the position of the cylindrical base material is balanced by the jetting pressure, thereby, the cylindrical base material is positioned at a predetermined position. Further, the cylindrical base material is in no mechanical contact with any device, so that the cylindrical base material is prevented from being damaged.

In an apparatus for positioning the cylindrical base material in which cylindrical axes of a plurality of cylindrical base materials are aligned with each other, and one of the cylindrical base materials is stacked on the other cylindrical base materials; a coating solution is continuously coated on the outer peripheral surfaces of the cylindrical base materials by a vertical coating apparatus while stacked cylindrical base materials are pushed vertically upward; and the cylindrical base material is positioned by a positioning means in which a hollow-cylindrical jetting means, having a jet opening to eject a fluid onto the outer peripheral surface of the cylindrical base material, is coaxially provided with the cylindrical base material at a position before or after coating, when there is only one cylindrical base material which is not correctly positioned, air ejected from the jetting apparatus enters into the connected portion at which end surfaces of the cylindrical base materials are contacted with each other, and thereby the cylindrical base material is lifted, inclined, or vibrated, thereby, all cylindrical base materials, moving under the condition that they are superimposed, are adversely affected, resulting in lowered coating property.

In the above described structure, the problems are solved when the jetting amount or jetting pressure of the fluid is controlled so as to be changed at the connected portion of respective cylindrical base materials. That is, the jetting amount of the fluid is lowered to zero, or lowered to less than 80% of the original jetting amount, at the above connected portion. Alternatively, it is preferable that the jetting pressure of the fluid is decreased to less than 80% of the original jetting pressure. More preferably, the jetting amount or jetting pressure is reduced between 0 and 70% of the original values.

Thus, the cylindrical base materials can be correctly positioned even at the contact portion between a plurality of cylindrical materials. When the cylindrical base materials are correctly or smoothly held and moved, fluctuations of the film thickness of the coating solution is reduced, and the coating property can be increased. Further, neither the cylindrical base materials nor the coater are damaged.

Further, the above-described object is attained by a method for positioning the cylindrical base material in which the cylindrical base material is positioned by a positioning means in which: a hollow-cylindrical jetting means, having a jet opening to eject a fluid onto the outer peripheral surface of the cylindrical base material, is coaxially provided with the cylindrical base material at a position before or after coating, in the process in which cylindrical axes of a plurality of cylindrical base materials are aligned with each other, and one of the cylindrical base materials is stacked on another cylindrical base material; and a coating solution is continuously coated on the outer peripheral surfaces of the cylindrical base materials by a vertical coating apparatus while stacked cylindrical base materials are pushed vertically upward, wherein the inner diameter of the surface on which the jet opening of the positioning means is provided, is set to be not larger than the inner diameter of the fluid coating section of the vertical coating apparatus.

Still further, the above-described object is attained by a method for positioning the cylindrical base material, in which the cylindrical base material is positioned by a positioning means, in which: a hollow-cylindrical jetting means, having a jet opening to eject a fluid onto the outer peripheral surface of the cylindrical base material, is coaxially provided with the cylindrical base material at a position before or after coating, in the process in which cylindrical axes of a plurality of cylindrical base materials are aligned with each other, and one of the cylindrical base materials is stacked on another cylindrical base material; and a coating solution is continuously coated on the outer peripheral surfaces of the cylindrical base materials by a vertical coating apparatus while stacked cylindrical base materials are pushed vertically upward, wherein the inner diameter of the surface, on which a jet opening of the positioning means is provided, is set to be not larger than that of the fluid coating section of the vertically coating apparatus.

In the above structure, when the outer diameter of the cylindrical base material is defined as D1, the inner diameter of the cylindrical inner surface having a jet opening of the positioning apparatus is defined as D2, and the inner diameter of the fluid coating section, forming a cylindrical inner surface of the vertical coating apparatus, is defined as D3, the positioning accuracy of the cylindrical base material is increased when the following relationships are set; $D1<D2\leqq D3$, and preferably $D1<D2<D3$.

Accordingly, contact of the outer shape of the cylindrical base material with the fluid coating section forming the cylindrical inner surface of the vertical coating apparatus, or the contact of the outer shape of the cylindrical base material with the cylindrical inner surface having a jet opening of the positioning apparatus, is prevented. Since there is a cylindrical base material having relatively poor angular accuracy or smoothness, a plurality of stacked cylindrical base materials are often unstable. When $D2>D3$, the positioning accuracy is less than acceptable one, and an entry portion of the coating apparatus easily contacts the cylindrical base material. In this connection, $(D2-D1)\geqq 20$ μm is preferable. The diameter of the jet opening is preferably 0.01 to 1.0 mm, and more preferably 0.05 to 0.7 mm.

In the positioning apparatus having a plurality of jet openings, more than two apparatus may be sequentially connected in the axial direction.

The preferable fluids for the positioning apparatus are air or an inert gas (for example, nitrogen gas). These fluids are preferably pure gases which satisfy more than C less 100 in Federal Standard 209D (Clean Room and Work Station Requirements Controlled Environments).

As a vertical coating apparatus, a slide hopper type, an extruding type, or a ring coater type apparatus can be utilized.

In order to attain the above object, in an apparatus for positioning the cylindrical base material in which the cylindrical base material is positioned by a positioning means in which: a ring-like jetting means, having a jet opening to eject a fluid onto the outer peripheral surface of the cylindrical base material, is coaxially provided with the cylindrical base material at a position before or after coating, in the process in which cylindrical axes of a plurality of cylindrical base materials are aligned on each other, and one of the cylindrical base materials is stacked on another cylindrical base material; and a coating solution is continuously coated on the outer peripheral surfaces of the cylindrical base materials by a vertical coating apparatus while stacked cylindrical base materials are being vertically pushed upward, it is preferable that a gap between the surface of the cylindrical base material and the jet opening of the jetting means, facing the surface of the cylindrical base material, is 20 μm to 3 mm, the amount of the jetted fluid per minute is 0.1 to 50 $m^3$/min, and a tapered portion is provided on the introducing portion of the positioning means.

The fluid ejected onto the outer peripheral surface of the cylindrical base material is preferably air at a temperature of 20° to 24° C., and at a humidity of 10 to 65% RH.

The amount ejected by the jetting means is preferably changed in the axial direction.

In order to attain the above object, in an apparatus for positioning the cylindrical base material which the cylindrical base material is positioned by a positioning means in which: a hollow-cylindrical jetting means, having a jet opening to eject a fluid onto the outer peripheral surface of the cylindrical base material, is coaxially provided with the cylindrical base material at a position before or after coating, when cylindrical axes of a plurality of cylindrical base materials are aligned on each other, and one of the cylindrical base materials is stacked on another cylindrical base material, and a coating solution is continuously coated on the outer peripheral surfaces of the cylindrical base materials by a vertical coating apparatus while stacked cylindrical base materials are vertically pushed upward, it is preferable that the ratio of the total opening area of a plurality of openings of the jetting means facing the surface of the cylindrical base material, and the plurality of exhaust ports near the jet openings is between 1:1 and 1:300.

In positioning the above structure, the ratio of the total area of the plurality of jet openings of the jetting means, which face the surface of the cylindrical base material, and the plurality of exhaust ports near the jet opening, is set between 1:1 and 1:300, and is preferably between 1:2 and 1:200. Thereby, the fluid is substantially and continuously ejected from a plurality of jet openings onto the outer peripheral surface of the cylindrical base material, and the cylindrical base material is thereby positioned. The fluid is exhausted from the exhaust ports outside the apparatus after the jetting operation. Thus, the cylindrical base materials can be correctly positioned even at the contacting portion between a plurality of cylindrical materials. When the cylindrical base materials are correctly or smoothly held and moved, fluctuation of the film thickness of the coating solution is reduced, and the coating property can be increased. Further, neither the cylindrical base materials nor the coater are damaged.

DETAILED DESCRIPTION OF THE PREFERRED EMBODIMENT

Figure 1:
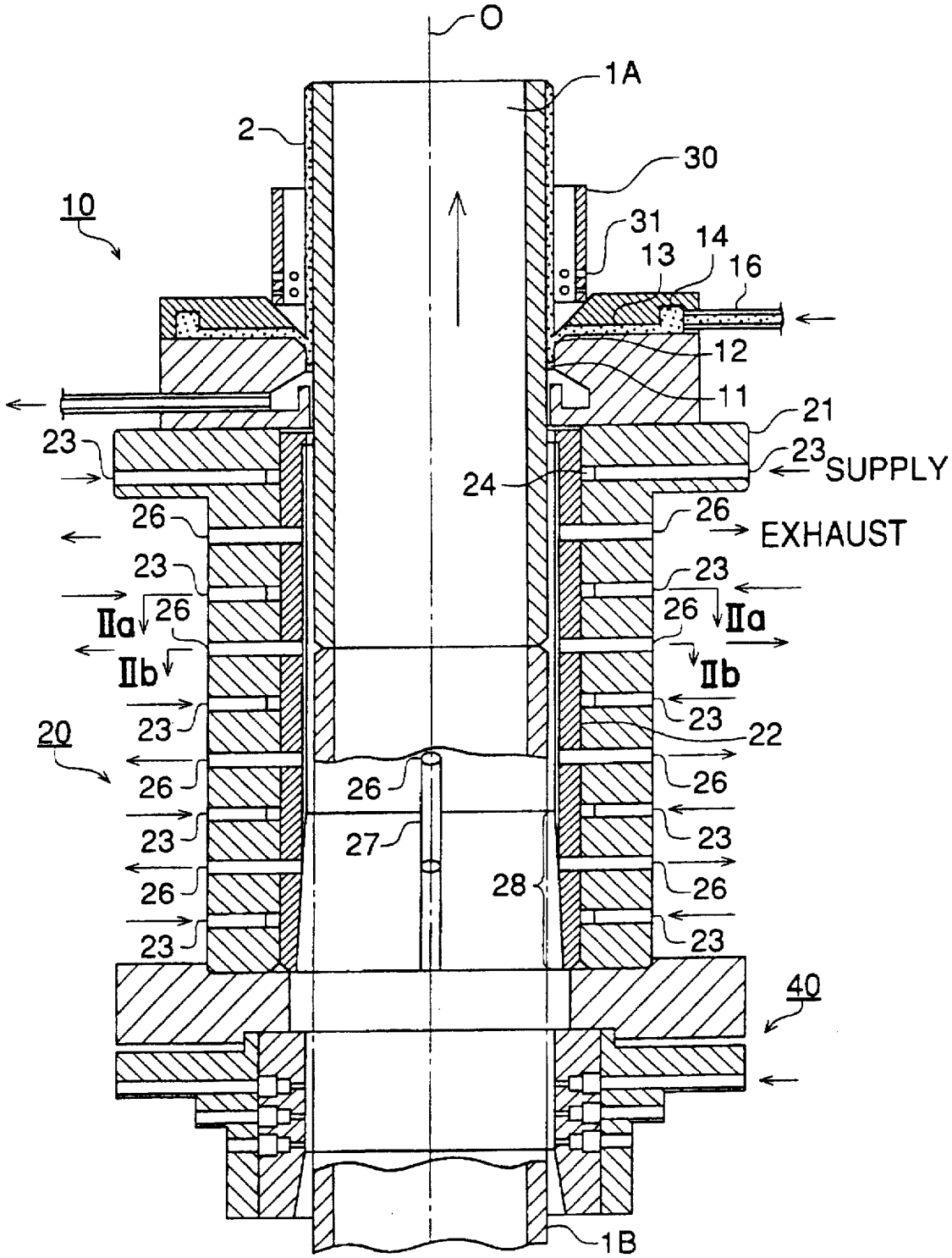
FIG. 1 is a vertical sectional view of a positioning apparatus and a coating apparatus according to the present invention.

Referring to the drawings, an example of the present invention will he detailed below.

FIG. 1 is a sectional view showing the overall vertical coating apparatus including a positioning apparatus of the present invention. The vertical type coating apparatus comprises: a circular coating apparatus 10 to coat a coating solution (photosensitive solution) 2 on cylindrical base materials 1A, 1B (cylindrical drums) vertically stacked along the center line O; a cylindrical base material positioning apparatus 20 fixed under the circular coating apparatus 10; a drying hood 30 provided above the vertical coating apparatus 10; and a supporting apparatus 40 fixed at a lower portion of the positioning apparatus 20.

In the circular coating apparatus 10, the following are provided: a coating head 11 which surrounds the outer periphery of the cylindrical base material 1A, to coat the processing solution 2; a tapered processing solution delivery port (processing solution sliding surface) 12, adjoining the coating head 11; a processing solution distribution slit 13 forming a narrow horizontal processing solution path; a coating solution distribution chamber 14, and a pressure reducing chamber 15. A processing solution supply pipe 16 is connected to the coating solution distribution chamber 14, and a processing solution is supplied by a force feed pump, not shown in the drawings. An air exhaust pipe 17 is connected to the pressure reduction chamber 15, and the pressure is reduced by an exhaust pump, not shown in the drawing.

The coating method of the vertical coating apparatus 10 is carried out as follows; the circular coating apparatus 10 is fixed; and coating is carried out from the upper end portion of the cylindrical base material 1A by the coating head 11, while the cylindrical base material 1A is moved upward in the arrowed direction along the centerline O.

A predetermined amount of the processing solution is stably fed by the force feed pump into the vertical coating apparatus 10, and the processing solution is supplied to the coating head 11 through the processing solution supply pipe 16, the coating solution distribution chamber 14, the processing solution distribution slit 13, and the processing solution delivery port 12. The processing solution is coated onto the surface of the cylindrical base material 1A and thereby a photoreceptor layer is formed during pressure reduction of the pressure reduction chamber 15 connected to the exhaust pump.

The circular drying hood 30 is fixed above the vertical coating apparatus 10. A large number of openings 31 are formed in the drying hood 30. The photoreceptor layer, formed on the cylindrical base material by the vertical coating apparatus 10, passes inside the drying hood 30, and the photosensitive solution 2 coated on the cylindrical base material is gradually dried. The drying operation is carried out when a solvent contained in the photosensitive solution is delivered outside through the openings 31.

Figure 2:
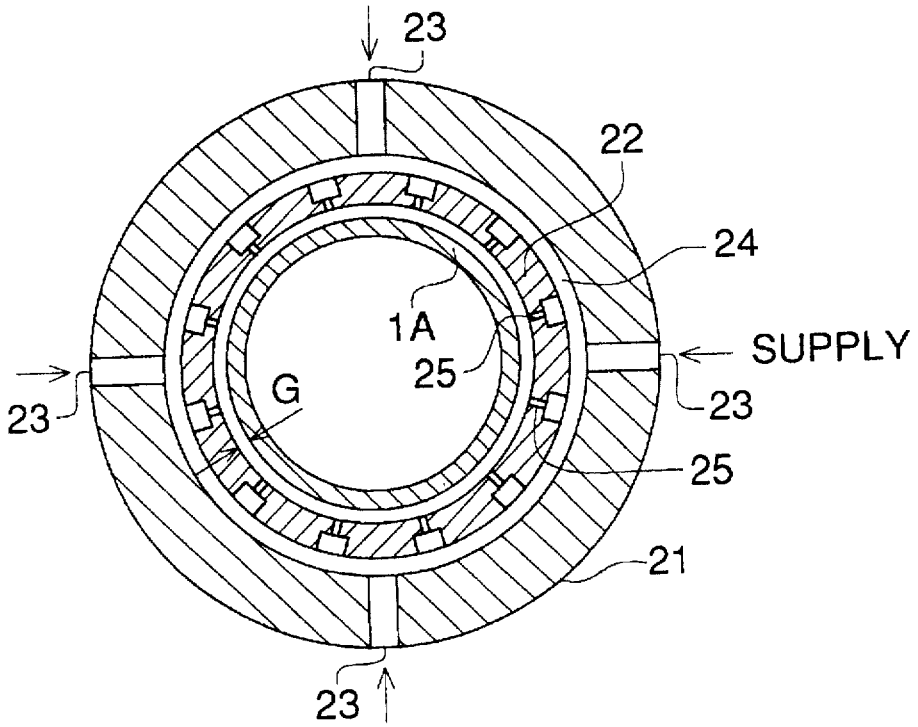
FIGS. 2(*a*) and 2(*b*) are sectional views respectively taken on lines A—A and B—B of the coating apparatus in FIG. 1.
Figure 2:
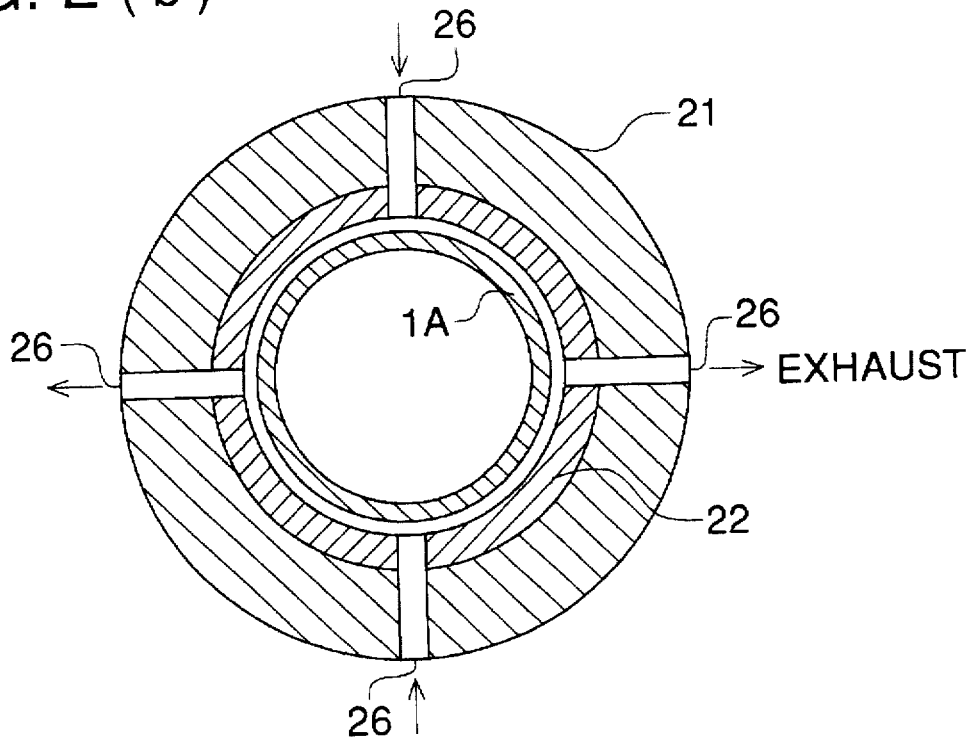

The cylindrical base material positioning apparatus 20 is fixed below the vertical coating apparatus 10. FIG. 2(*a*) is a sectional view taken on line A—A, (air supply portion), of the cylindrical base material positioning apparatus 20 in FIG. 1, and FIG. 2(*b*) is a sectional view taken on line B—B (exhaust portion) of the apparatus in FIG. 1.

The cylindrical base material positioning apparatus 20 comprises an outer cylindrical member, and an inner cylindrical member 22 fixed in the outer cylindrical member 21. A plurality of air supply ports 23 and a plurality of exhaust ports 26, which penetrate both members, are provided in the outer cylindrical member 21 and the inner cylindrical member 22. The plurality of air supply ports are connected to an air supply pump 29, and a pressurized fluid such as air, or the like, is supplied.

As shown in FIG. 1 and FIG. 2(*a*), 4 radial air supply ports 23 are provided horizontally in the outer cylindrical member 21, and are provided vertically in a plurality of steps (5 steps in the drawing). A horizontal slot 24 is provided in the inner peripheral surface of the outer cylindrical member 21, and a horizontal channel is formed between outer peripheral surface of the inner cylindrical member 22 and the inner peripheral surface of the outer cylindrical member 21. The horizontal slot 24 communicates with 4 air supply ports 23 provided radially and horizontally. Horizontal penetrating 12 jet openings 25 are provided in the inner cylindrical member 22. The jet openings 25 face the outer peripheral surface of the cylindrical base material 1 with a gap G. The dimension of the gap G is between 20 μm and 3 mm, and preferably is 30 μm to 2 mm. In cases where the dimension of the gap is not larger than 20 μm, when the cylindrical base material 1 deviates even a little, it contacts the inner cylinder member 22, and the cylindrical base material 1 is easily damaged. Further, when the dimension of the gap G is not smaller than 3 mm, the positioning accuracy of the cylindrical base material 1 is lowered. The jet opening 25 is a nozzle having a small diameter of 0.01 to 1.0 mm, and is preferably 0.05 to 0.5 mm.

As shown in FIGS. 1 and 2(*b*), 4 radial exhaust ports 26 are horizontally arranged, and further these ports are also vertically arranged in a plurality of steps (5 steps in the drawing). In the vertical direction, the exhaust ports 26 are reciprocally arranged with the air supply ports 23. A vertical slot 27 is provided in the inner peripheral surface of the inner cylindrical member 22, and communicates with the exhaust ports 26 provided in a plurality of steps.

The lower portion of the inner peripheral surface of the inner cylindrical member 22 is formed of a tapered surface 28 in which the diameter of the inlet is larger than that of the outlet. This tapered surface 28 is formed of a conical surface such that, for example, the axial length is 50 mm, and a single side inclination angle is 0.5 mm. The taper ratio of the tapered surface 28 is 0.005 to 0.2, and preferably is 0.01 to 0.1. When this tapered surface 28 is provided, the position of the cylindrical base material 1 is regulated when the cylindrical base material 1 enters into the positioning apparatus 20 while being horizontally moved or inclined, therefore the tapered surface is effective. In the case where this tapered surface 28 is provided, when the cylindrical base material 1 enters into the inner cylindrical member 22, it prevents the leading edge portion of the cylindrical base material 1 from contacting the inner peripheral surface of the inner cylindrical member 22.

A fluid, fed by pressure from the air supply pump 29, is introduced from a plurality of air supply ports 23 to the outer cylindrical member 21, ejected from a plurality of jet openings 25 through the horizontal slots 24, and a uniform fluid film layer is formed on the outer peripheral surface of the cylindrical base material 1A (1B). The fluid after jet, is discharged outside the apparatus from a plurality of exhaust ports 26 through the vertical slot 27.

An amount of the fluid per minute supplied to the air supply ports 23 is preferably 0.1 to 50 $m^3$/min. When the amount of the fluid is smaller than 0.1 $m^3$/min, the positioning accuracy of the cylindrical base material is lowered extremely, and when the amount of the fluid is greater than 50 $m^3$/min, the stacked cylindrical base materials 1 are vibrated by the strong gas flow, resulting in a nonuniform solution film. Therefore, specifically, the amount of the fluid per minute is preferably 0.2 to 20 $m^3$/min. In this manner, when the amount of the fluid to be regulated and supplied, is not controlled, instead of the fluid pressure regulation, the solution film is adversely influenced (nonuniform film thickness) just after coating. The fluid amount per minute is measured at the entrance of the air supply port 23 of the positioning apparatus 20. It is preferable that the flow amount of the fluid, supplied to the plurality of supply air ports 23 per minute, is the same in the axial direction, or that the flow amount in the upper portion is larger than that in the lower portion.

The diameter of the round jet opening 25 may be 0.01 to 1 mm, but preferably is 0.05 to 0.5 mm, for example, 0.2 to 0.5 mm. The diameter of the round exhaust port 26 may be 1.0 to 10 mm, but preferably is 2.0 to 8.0 mm, for example, 3 to 5 mm. The jet opening 25 and exhaust port 26 are integrally assembled into the side facing the outer peripheral surface of the cylindrical base material 1, of the member which forms the innermost surface (inner cylindrical member 22) of the positioning means 20.

The ratio of the total area of the opening (S ratio) of the plurality of jet openings 25 of the jetting means facing the cylindrical base material Surface compared to the plurality of exhaust ports 26 adjoining the jet openings 25, is set from 1:1 through 1:300. When the ratio of the total area (S ratio) of the jet openings 25 and exhaust ports 26 is larger than 1:1, since the fluid leaks outside the jetting means, the coated solution film is vibrated, and the coating property is adversely influenced. When the ratio of total area (S ratio) of openings is less than 1:300, an unacceptable flow is caused in the fluid by the exhaust gas, and the solution film formation is unstable, or the positioning function is lowered. Therefore, the ratio of the total area (S ratio) of openings is preferably from 1:2 through 1:200.

The density of the arrangement of the plurality of jetting nozzles 25 and the plurality of exhaust ports 26 which are provided in the jetting means, may be the same along the axial direction of the jetting means, but preferably is greater in the upper portion in the axial direction.

The amount of the fluid ejected from the jet openings 25 is controlled so as to be changed at the connected portion by a connection portion detection means (53) to detect the connected portion of the plurality of cylindrical base materials, or changed by a timer means (51).

Alternatively, the pressure of the fluid ejected from the jet openings 25 is controlled so as to be changed at the connected portion by a connection portion detection means (53) to detect the connected portion of the plurality of cylindrical base materials, or can also be changed by a timer means (51).

The connected portion between the cylindrical base materials 1 can be easily detected by using, for example, reflection ratio variation detection, magnetism variation measurement, eddy current measurement, electric capacity variation measurement, laser measurement, etc., as the connected portion detection means.

The connected portion detection between the cylindrical base materials 1 by the timer means, is carried out by detecting the length of the cylindrical base materials 1, the speed of movement of the cylindrical base materials, the distance between a plurality of jet openings 25, the distance of first jet opening of the jetting means, or the like.

In this manner, although the positioning apparatus 20 shown in FIG. 1 is formed into one unit, more than two units may be sequentially connected vertically.

The fluid supplied into the air supply port 23, is preferably air, or an inert gas such as, for example, nitrogen gas. The fluid may be a pure gas which is more than Class 100 in the JIS standard.

As a vertical coating apparatus connected to the positioning apparatus of the present invention, a slide hopper type apparatus, an extruding type apparatus, a ring coater, or etc., may be used.

EXAMPLE

Next, the present invention will be explained according to a specific example, however, the present invention is not limited to this example.

Example 1

(Example and the Comparative Example)

An aluminum drum supporting body of the diameter of 80 mm, and the height of 355 mm, the surface of which is specular-gloss-processed, is used as the electro-conductive supporting body (cylindrical base body) 1.

Figure 3:
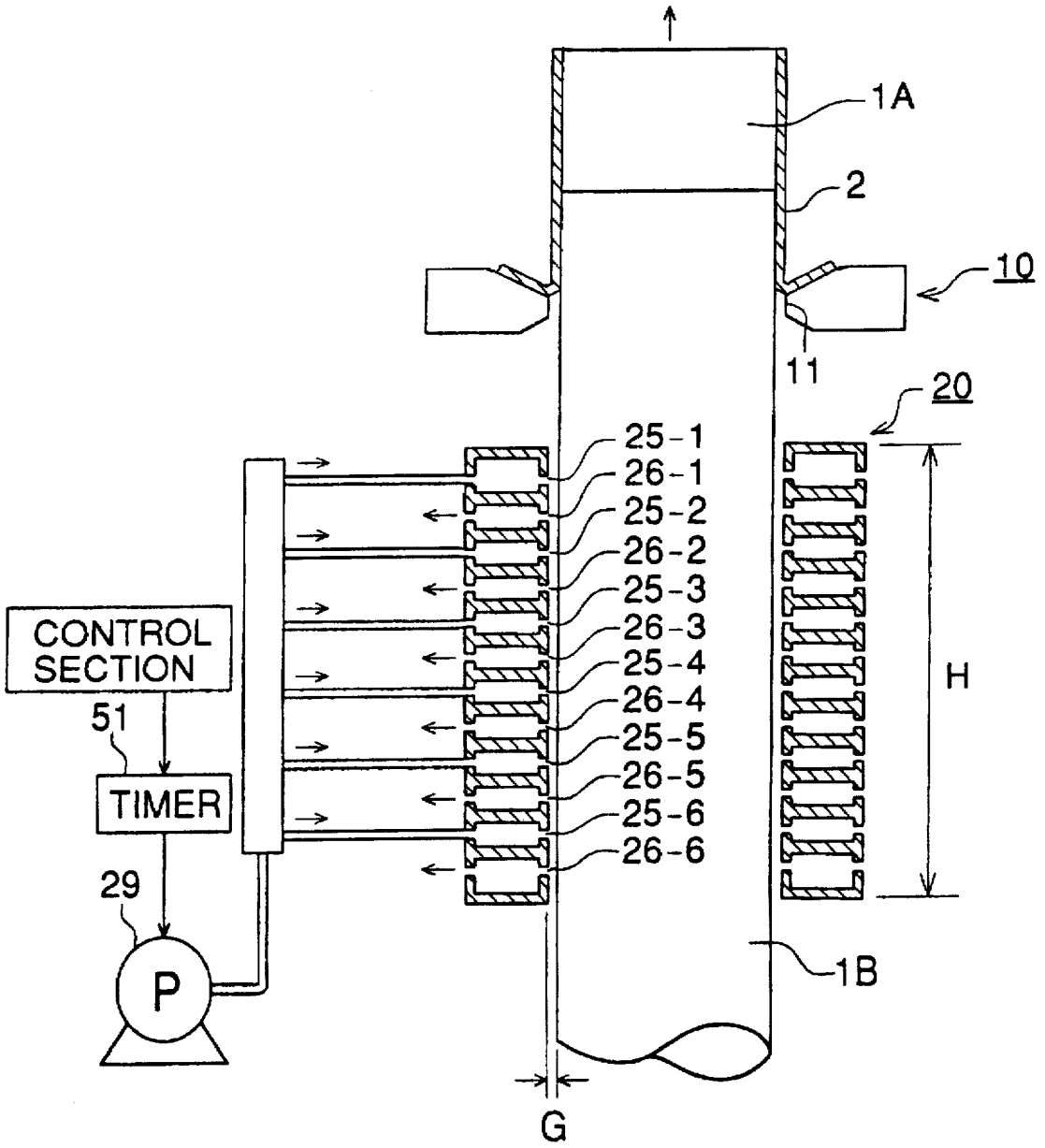
FIG. 3 is an illustrative sectional view showing the coating apparatus and the positioning apparatus in Examples 1 through 3.
Figure 4:
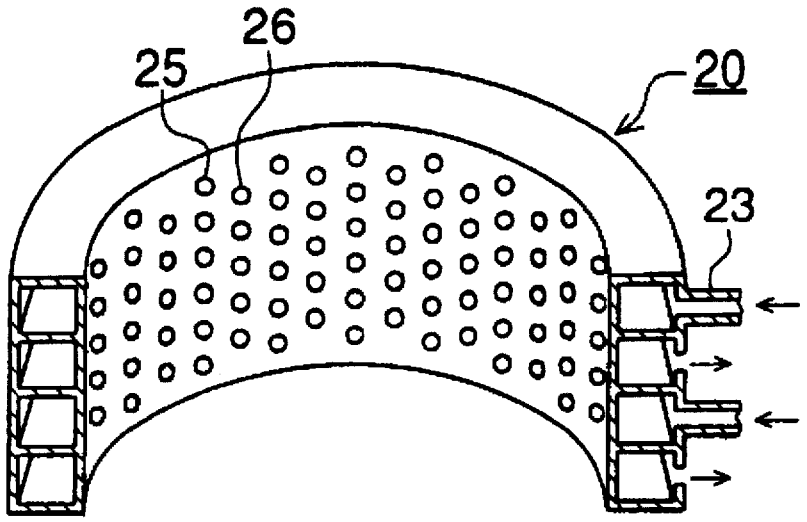
FIG. 4 is a partially fragmentary perspective view showing the positioning apparatus in FIG. 3.

As described below, a coating solution component UCL-1 (3.0 W/V % polymer concentration) is prepared, and coated on the electro-conductive supporting body 1 using a slide hopper type coating apparatus 10 as shown by FIG. 1. FIG. 3 is an illustrative sectional view showing a coating apparatus 10 and a positioning apparatus 20 provided with a timer control means, and FIG. 4 is a partial fragmentary perspective view showing the positioning apparatus 20. In this example, the positioning apparatus 20 (length H=250 mm) shown in FIG. 3, is provided just before the coating apparatus 10. The movement rate of the cylindrical base material 1 is 20 mm/sec, and a gap between the coater (coating head) 11 and the cylindrical base material, is 100 μm, and thus continuous coating is carried out.

Setting Values of the Positioning Apparatus

Gap G between a blowing surface and an outer surface of

| | |
|---|---|
| a cylindrical base material | 70 μm |
| Amount of gas fluid | 0.3 $m^3$/min |
| Diameter of gas blowing hole 25 | 0.5 mm |
| Diameter of exhaust hole 26 | 3 mm |

UCL-1 Coating Solution components CP Copolymer nylon resin (CM-8000 made by Toray Co.)

Methanol/n-butanol=10/1 (volume ratio)

Only when the connected portion of adjoining cylindrical base materials is located at the jet opening 25 of the positioning means, the fluid such as nitrogen gas, etc., from the jet opening 25 is temporarily stopped, and continuous coating is carried out by a timer control which is computed according to the coating speed of the cylindrical base material, the length of the cylindrical base material, the distance from the reference portion to the first jet opening 25, the distance from the jet opening to the next jet opening, etc. Due to the above operations, no vibration and no swinging of the cylindrical base material 1 occur, and the coating property is excellent. However, when coating is carried out without temporarily stopping the jetting of the fluid, the nitrogen gas enters into a gap of the connected portion formed between adjoining cylindrical base materials 1 which are poorly aligned. Thereby, the cylindrical base material 1 is lifted upward while inclined, all stacked cylindrical base materials 1 vibrate, swing, and rub against the inner wall of the positioning apparatus 20, or the coater 11, and consequently, nonuniform coating or scratching occurs.

Example 2

(Example and the Comparative Example)

An aluminum drum supporting body of the diameter of 80 mm, and the height of 355 mm, the surface of which is specular-gloss-processed, is used as the electro-conductive supporting body (cylindrical base body).

As described below, a coating solution component CGL-2 (3.0 W/V % polymer concentration) is prepared and coated onto the supporting body using the slide hopper type coating apparatus 10 as shown in FIG. 1. In this case, a circular positioning apparatus (the length=250 mm), shown in FIG. 3, is provided just before the coating apparatus 10, and continuous coating is carried out under the condition that the movement speed of the cylindrical base material 1 is 30 mm/sec, and the gap between the coater 11 and the cylindrical base material 1 is 100 μm.

CGL-2 coating solution components perylene pigment (CGM-2)

butyral resin (Eslec BX-L, by Sekisui Chemical Co.)

methyl ethyl ketone

The above coating solution components, (the amount of the solid is fixed at a solid weight ratio of CGM-1:BX-L= 2:1), are dispersed for 20 hours by utilizing a sand mill.

CGM-2 Compound of (1) and (2)

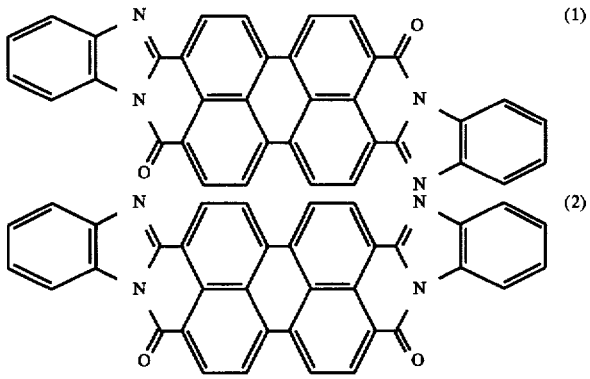

Only when the connected portion of adjoining cylindrical base materials 1 is located at the jet opening 25 of the positioning means, the fluid quantity of nitrogen gas from the jet opening 25 is temporarily decreased to 30% of the initial quantity, and continuous coating is carried out by a timer control which is computed according to the coating speed of the cylindrical base material, the length of the cylindrical base material, the distance from the reference portion to the first jet opening 25, the distance from the jet opening to the next jet opening, etc.

Due to the above operations, no vibration nor swinging of the cylindrical base material 1 occurs, and the coating property is excellent. When coating is carried out without temporarily reducing the quantity of the fluid of the nitrogen gas, the nitrogen gas enters into a gap of the connected portion formed between adjoining cylindrical base materials 1 which are poorly aligned with each other. Thereby, the cylindrical base material 1 is lifted upward while inclined, all stacked cylindrical base materials 1 vibrate, swing, and rub against the inner wall of the positioning apparatus 20, or the coater 11, and therefore, nonuniform coating or scratching occurs.

Example 3

(Example)

As the electro-conductive supporting body (cylindrical base material) 1, an aluminum drum supporting body which is the same as that of the Example 1, is used.

As described below, a coating solution component CTL-1 (35 W/V % solid concentration) is prepared and coated onto the supporting body using the slide hopper type coating apparatus 10 as shown in FIG. 1. In this case, a positioning apparatus 20 (the length=250 mm), shown in FIG. 3, is provided just before the coating apparatus 10, and continuous coating is carried out under the condition that the movement rate of the cylindrical base material 1 is 5 mm/sec, and a gap between the coater 11 and the cylindrical base material 1 is 250 μm.

CTL-1 Coating Solution Components

CTM-1 polycarbonate (Z-200, by Mitsubishi Gas Chemical Co.)

1, 2-dichloroethane

The amount of the solid is fixed at the solid weight ratio of CTM-1:Z-200=0.89:1.

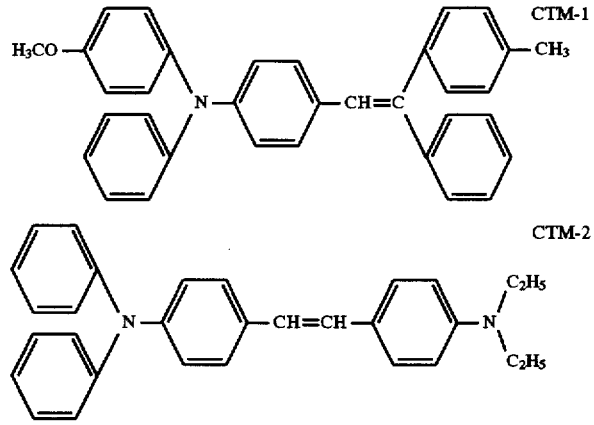

Only when the connected portion of adjoining cylindrical base materials 1 is located at the jet opening of the positioning means, the fluid quantity of nitrogen gas from the jet opening is temporarily decreased to 20% of the initial quantity, and continuous coating is carried out by a timer control which is computed according to the coating speed of the cylindrical base material, the length of the cylindrical base material, the distance from the reference portion to the first jet opening, the distance from the jet opening to the next jet opening, etc.

Due to the above operations, no vibration or no swinging of the cylindrical base material 1 occurs, and the coating property is excellent. When coating is carried out without temporarily reducing the quantity of the fluid of the nitrogen gas, the nitrogen gas enters into a gap of the connected portion formed between adjoining cylindrical base materials 1 which are poorly aligned with each other. Thereby, the cylindrical base material 1 is lifted up while inclined, all stacked cylindrical base materials 1 vibrate, swing, and rub against the inner wall of the positioning apparatus 20, or the coater 11, and therefore, nonuniform coating or scratching occurs.

Example 4

(Example and the Comparative Example)

An aluminum drum supporting body of the diameter of 80 mm, and the height of 355 mm, the surface of which is specular-gloss-processed, is used as the electro-conductive supporting body (cylindrical base body) 1.

Figure 5:
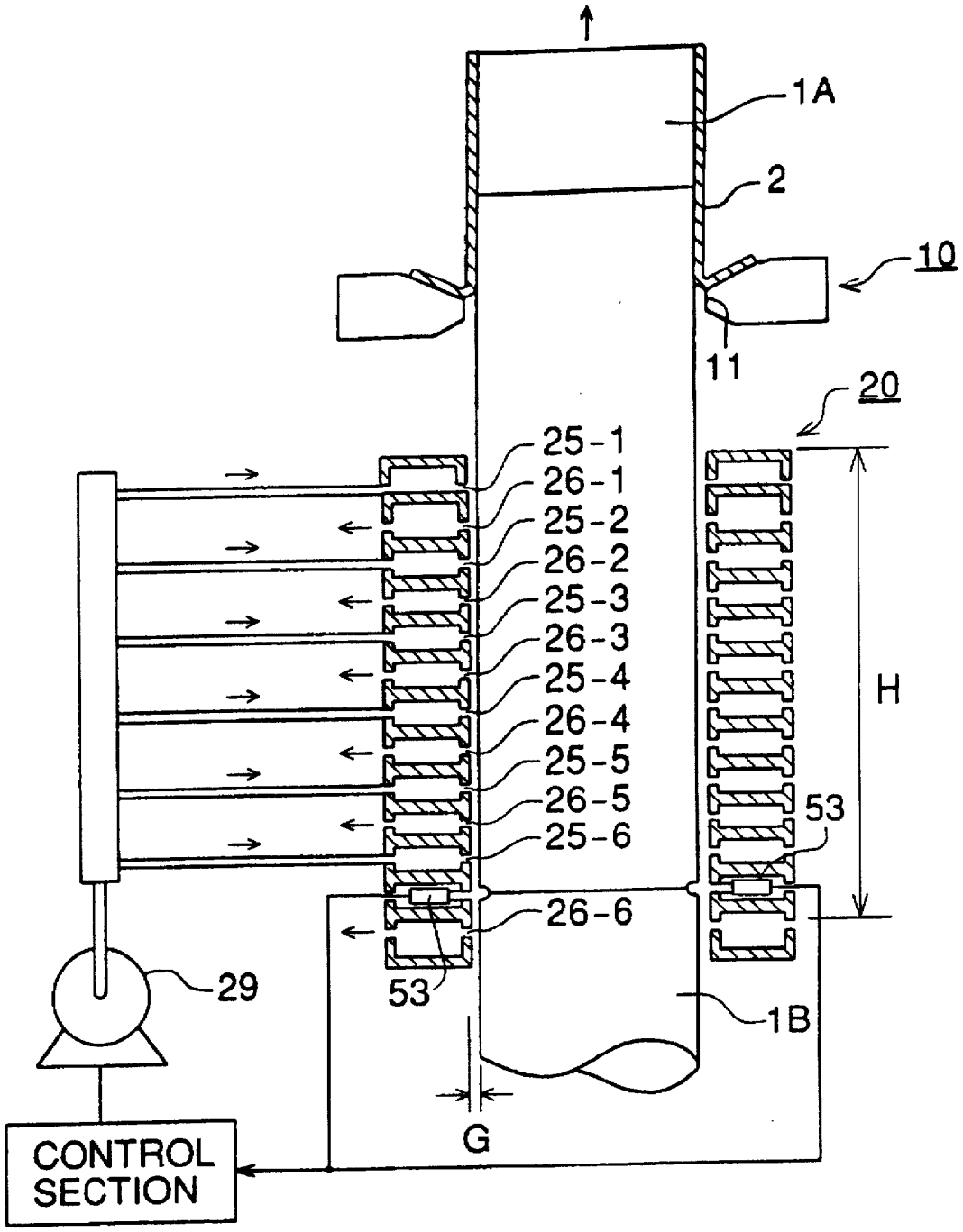
FIG. 5 is an illustrative sectional view showing the positioning apparatus in Examples 4 through 6.

As described below, a coating solution component UCL-2 (3.0 W/V % polymer concentration) is prepared and coated onto the electro-conductive supporting body 1 using a slide hopper type coating apparatus 10 as shown by FIG. 1. In this case, the circular positioning apparatus (length H=250 mm, a connected portion detection apparatus 53 is assembled in the lower end of the first jet opening, that is the lowest jet opening), shown in FIG. 5, is provided just before the coating apparatus 10. The movement rate of the cylindrical base material 1 is set to 20 mm/sec, and the gap between the coater (coating head) 11 and the cylindrical base material 1, is set to 100 μm, and continuous coating is carried out.

UCL-2 Coating Solution Components vinyl chloride-vinyl acetate copolymer (Eslec MF-10, made by Sekisui Chemical Co.)

acetone/cyclohexane=10/1 (volume ratio)

Only when the connected portion of adjoining cylindrical base materials 1 is located at the jet opening 25 of the positioning apparatus 20, the fluid quantity of nitrogen gas from the jet opening is temporarily stopped, and continuous coating is carried out. Due to the above operations, no vibration nor swinging of the cylindrical base material 1 occurs, and the coating property is excellent. When coating is carried out without temporarily stopping the nitrogen gas, the nitrogen gas enters into a gap of the connected portion formed between adjoining cylindrical base materials 1 which are poorly aligned with each other. Thereby, the cylindrical base material 1 is lifted up while inclined, all stacked cylindrical base materials 1 vibrate, swing, and rub against the inner wall of the positioning apparatus 20, or the coater 11, and therefore, nonuniform coating or scratching occurs.

Example 5

(Example and the Comparative Example)

An aluminum drum supporting body of the diameter of 80 mm, and the height of 355 mm, the surface of which is specular-gloss-processed, is used as the electro-conductive supporting body (cylindrical base body) 1.

As described below, a coating solution component CGL-3 (3.0 W/V % polymer concentration) is prepared, and coated onto the electro-conductive supporting body 1 using the slide hopper type coating apparatus 10 as shown in FIG. 1. In this case, a circular positioning apparatus 20 (the length=270 mm, a connected portion detection apparatus 53 is assembled in the lower end of the first jet opening 25-6, that is the lowest jet opening), shown in FIG. 5, is provided just before the coating apparatus 10, and continuous coating is carried out under the condition that the movement ratio of the cylindrical base material 1 is 30 mm/sec, and a gap length between the coater 11 and the cylindrical base material 1 is 100 μm.

CGL-3 Coating Solution Components

Y-type titanyl phthalocyanine pigment (CGM-3)

silicone resin (KR-5240 by Shinetsu chemical co.)

t-butyl acetate

The above coating solution components, (the amount of the solid is fixed at a solid weight ratio of CGM-2:KR-5240=2:1), are dispersed for 20 hours by utilizing a sand mill.

CGM-3 (Y-typetitanyl phthalocyanine)

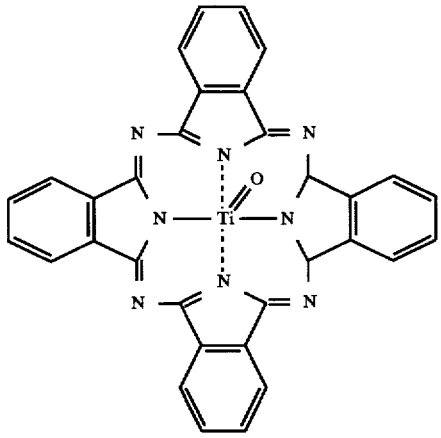

Only when the connected portion of adjoining cylindrical base materials 1 is located at the jet opening of the positioning apparatus 20, the fluid quantity of air from the jet opening is temporarily decreased to 10% of the initial quantity, and continuous coating is carried out, with no vibration nor swinging of the cylindrical base material 1, and the coating property is excellent. When coating is carried out without temporarily reducing the quantity of the fluid of air, the air flow enters into the gap of the connected portion formed between adjoining plural cylindrical base materials 1 which are badly aligned with each other. Thereby, the cylindrical base material 1 is lifted up while inclined, all stacked cylindrical base materials 1 vibrate, swing, and rub against the inner wall of the positioning apparatus 20, or the coater 11, and therefore, nonuniform coating or scratching occurs.

Example 6

(Example and Comparative Example)

The same aluminum drum supporting body as that in Example 1 is used as the electro-conductive supporting body (cylindrical base material) 1.

As described below, a coating solution component CTL-2 (35 W/V % polymer concentration) is prepared and coated onto the supporting body using the slide hopper type coating apparatus 10 as shown in FIG. 1. In this case, a positioning apparatus 20 (the length=250 mm, a connected portion detection apparatus 53 is assembled in the lower end of the first jet opening 25-6, that is the lowest jet opening), shown in FIG. 5, is provided just before the coating apparatus 10, and thus continuous coating is carried out under the condition that the movement ratio of the cylindrical base material 1 is 5 mm/sec, and the gap length between the coater 11 and the cylindrical base material 1 is 250 μm.

CTL-2 Coating Solution Components

CTM-2 polycarbonate (Z-200, by Mitsubishi Gas Chemical Co.)

1, 2-dichloroethane

The amount of the solid is fixed at the solid weight ratio of CTM-1:Z-200=0.89:1.

Only when the connected portion of adjoining cylindrical base materials 1 is located at the jet opening of the positioning apparatus 20, the pressure of air from the jet opening is temporarily decreased to 20% of the initial pressure by the connected portion detection apparatus 53, continuous coating is carried out with no vibration nor swinging of the cylindrical base material 1, and the coating property is excellent. When coating is carried out without temporarily reducing the pressure of the fluid of air, the air flow enters into the gap of the connected portion formed between adjoining plural cylindrical base materials 1 which are poorly aligned with each other. Thereby, the cylindrical base material 1 is lifted up while inclined, all stacked cylindrical base materials 1 vibrate, swing, and rub against the inner wall of the positioning apparatus 20, or the coater 11, and therefore, nonuniform coating or scratching occurs.

Example 7

(Example and the Comparative Example)

An aluminum drum supporting body of the diameter of 80 mm, and the height of 355 mm, the surface of which is specular-gloss-processed, is used as the electro-conductive supporting body (cylindrical base body) 1.

Figure 6:
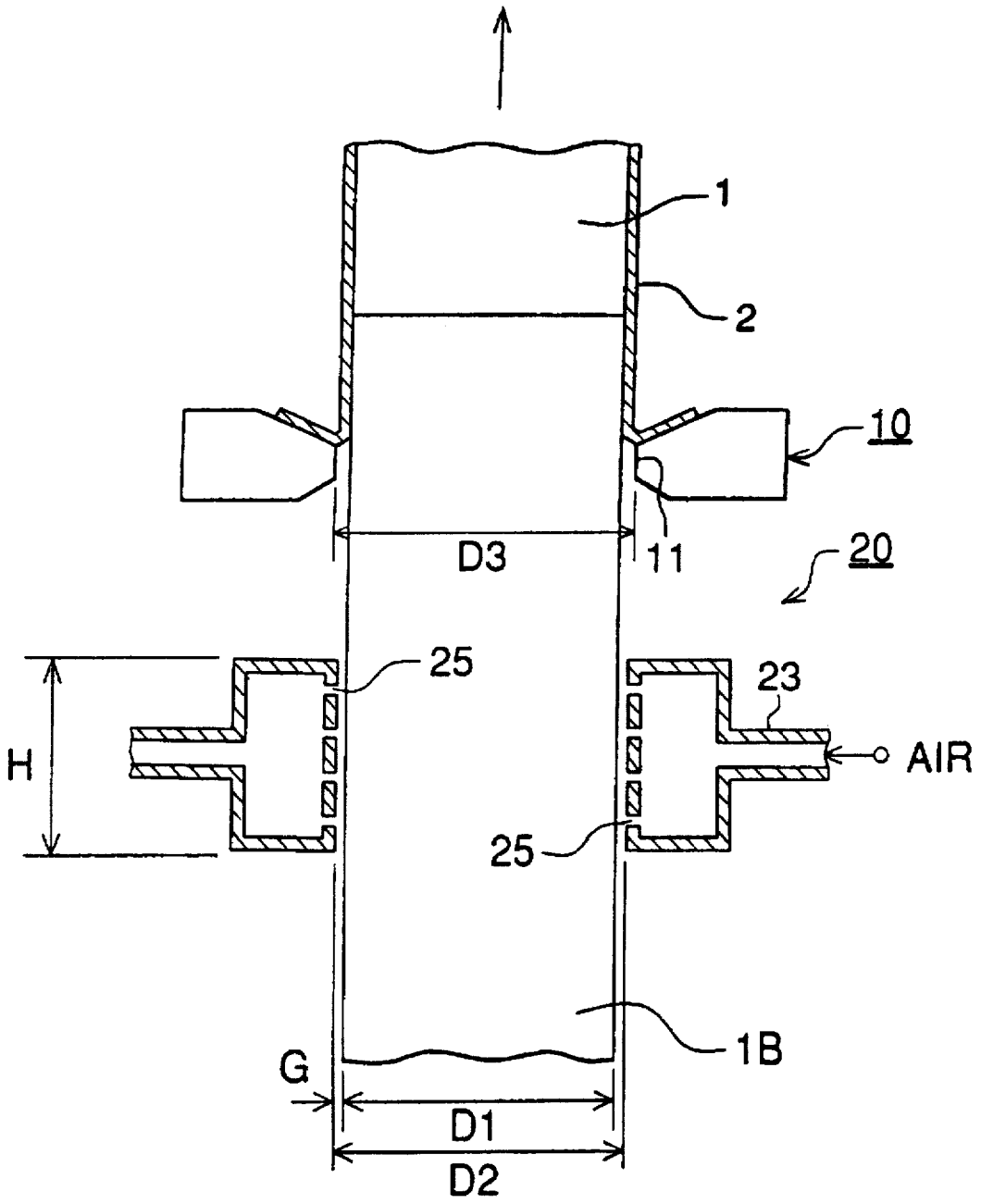
FIG. 6 is an illustrative sectional view of the coating apparatus and the positioning apparatus in Example 7.
Figure 7:
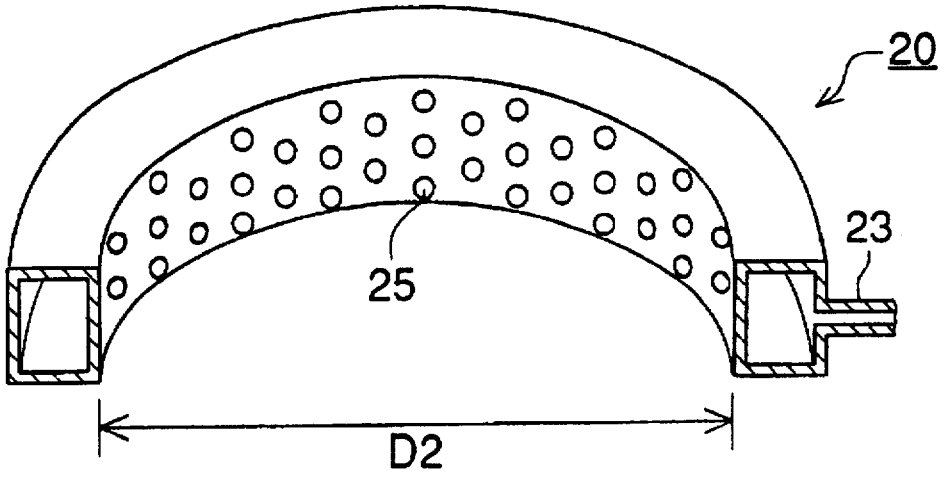
FIG. 7 is a partially fragmentary perspective view showing the positioning apparatus in FIG. 6.

As described below, a coating solution component UCL-1 (3.0 W/V % polymer concentration) is prepared and coated onto the supporting body using the slide hopper type coating apparatus 10 (the inner diameter D3=80.2 mm) as shown in FIG. 1. FIG. 6 is an illustrative sectional view showing the coating apparatus and the positioning apparatus. FIG. 7 is a partial fragmentary perspective view showing the positioning apparatus. In this Example, a circular positioning apparatus 20 (the length=250 mm, inner diameter D2), as shown in FIG. 6, is provided just before the coating apparatus 10. Then, while inner diameter D2 of the circular jetting surface of the positioning apparatus is changed as described in the following table 1, continuous coating is carried out under the condition that the movement speed of the cylindrical base material 1 is 20 mm/sec, and the gap length between the coater (coating head) 11 and the cylindrical base material 1 is 100 μm.

UCL-1 Coating Solution Components

Copolymer nylon resin (CM-8000, by Toray Co.)

Methanol/n-butanol=10/1 (volume ratio)

The result of coating in Example and Comparative example is shown in Table 1.

TABLE 1

| Photoreceptor drum No. | 1-1 | 1-2 | 1-3 | 1-4 |
|---|---|---|---|---|
| Outer diameter of supporting body D1 [mm] | 80.00 | 80.00 | 80.00 | 80.00 |
| Inner diameter of coating apparatus [mm] | 80.20 | 80.20 | 80.20 | 80.20 |
| Inner diameter of positioning apparatus D2 [mm] | 80.19 | 80.15 | 80.04 | 80.30 |
| Positioning performance | good | good | good | Unstable. The drum contacts the entrance of the coater. The drum contacts the positioning apparatus wall. |
| Coating property | good | good | good | Dragging, frictional drag occur. Uneven coating due to vibration at contact occurs. |

As shown in Table 1, in the present example with respect to photoreceptor drum Nos. 1-1, 1-2, 1-3, the inner diameter D2 of the positioning apparatus 20, and the inner diameter D3 of the coating apparatus 10 have the relationship of D1<D2<D3, and the positioning accuracy is high, no damage or no uneven coating occurs, and coating property is excellent. In contrast to this, in the comparative example of the photoreceptor drum No.1-4 in which the inner diameter D2 and the inner diameter D3 have the relationship of D2>D3, the positioning performance is unstable, the cylindrical base material 1 contacts the entrance of the coating apparatus 10, the cylindrical base material 1 contacts the inner wall surface of the positioning apparatus 20, which are problems, and uneven coating occurs due to vibration at the time of contact. Further, the coating property of the coating solution onto the cylindrical base material is unacceptable, and problems such as dragging or frictional drag occur.

Example 8

(Example and the Comparative Example)

An aluminum drum supporting body of the diameter of 80 mm, and the height of 355 mm, the surface of which is specular-gloss-processed, is used as the electro-conductive supporting body (cylindrical base body) 1.

Figure 8:
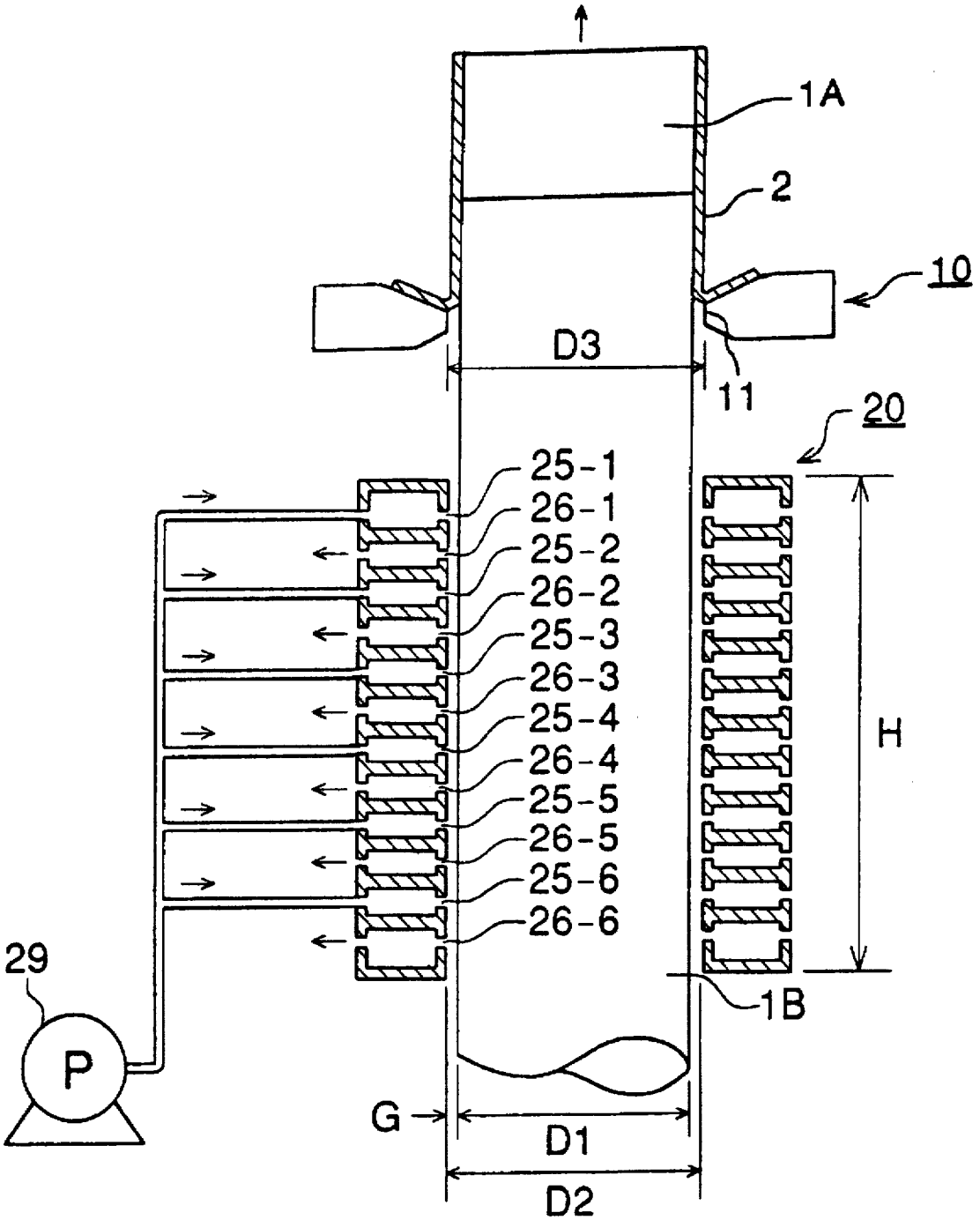
FIG. 8 is an illustrative sectional view showing the positioning apparatus in Examples 8 and 9.
Figure 9:
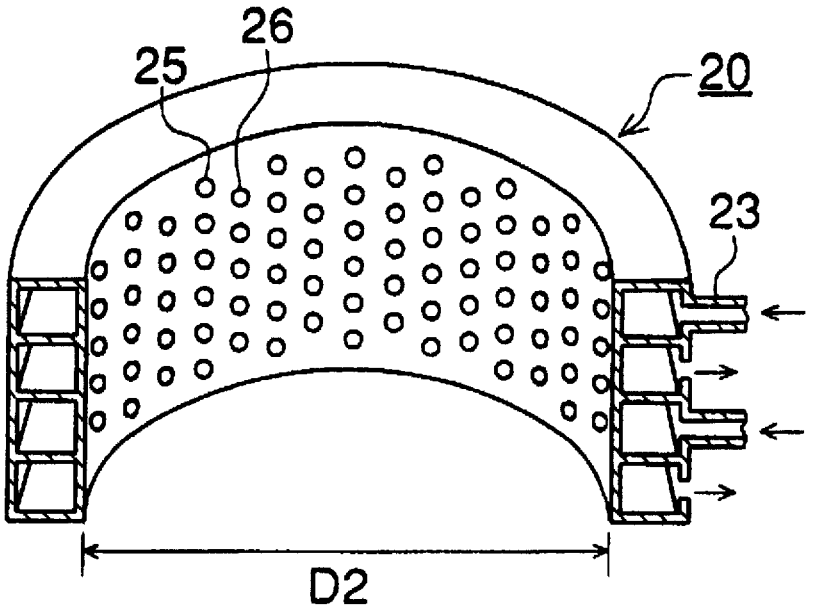
FIG. 9 is a partially fragmentary perspective view showing the positioning apparatus in FIG. 8.

As described below, a coating solution component CGL-2 (3.0 W/V % polymer concentration) is prepared and coated onto the supporting body using the slide hopper type coating apparatus 10 (the inner diameter D3=80.2 mm) as shown in FIG. 1. FIG. 8 is an illustrative sectional view showing the coating apparatus 10 and the positioning apparatus 20. FIG. 9 is a partial fragmentary perspective view showing the positioning apparatus 20. In this Example, a circular positioning apparatus 20 (the length=200 mm, inner diameter D2), shown in FIG. 8, is provided just before the coating apparatus 10. Then, while inner diameter D2 of the circular jetting surface of the positioning apparatus is changed as described in the following Table 2, continuous coating is carried out under the condition that the movement rate of the cylindrical base material 1 is 25 mm/sec, and the gap length between the coater (coating head) 11 and the cylindrical base material 1 is 100 μm.

CGL-1 Coating Solution Components perylene pigment (CGM-2)

butyral resin (Eslec BX-L, by Sekisui Chemical Co.)

methyl ethyl ketone

The above coating solution components, (the amount of the solid is fixed at a solid weight ratio of CGM-2:BX-L=2:1), are dispersed for 20 hours by utilizing a sand mill.

CGM-2 Compound of (1) and (2)

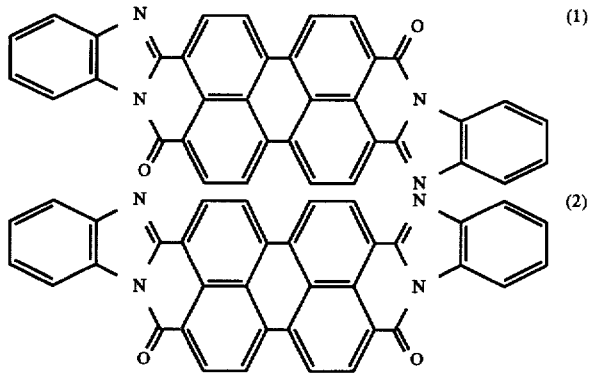

A result of the coating is shown in Table 2.

TABLE 2

| Photoreceptor drum No. | 2-1 | 2-2 | 2-3 | 2-4 |
|---|---|---|---|---|
| Outer diameter of supporting body D1 [mm] | 80.00 | 80.00 | 80.00 | 80.00 |
| Inner diameter of coating apparatus [mm] | 80.20 | 80.20 | 80.20 | 80.20 |
| Inner diameter of positioning apparatus D2 [mm] | 80.18 | 80.13 | 80.04 | 80.30 |
| Positioning performance | good | good | good | Unstable. The drum contacts the positioning apparatus wall or the coater. |
| Coating property | good | good | good | Dragging, and frictional drag occur. Uneven color due to vibration at contact occurs. |

As shown in Table 2, in the present example with respect to photoreceptor drum Nos. 2-1, 2-2, 2-3, the inner diameter D2 of the positioning apparatus 20, and the inner diameter D3 of the coating apparatus 10 have the relationship of D1<D2<D3, and the positioning accuracy is high, no damage nor uneven coating occurs, and coating property is excellent. In contrast to this, in the comparative example of the photoreceptor drum No.2-4 in which the inner diameter D2 and the inner diameter D3 have the relationship of D2>D3, the positioning performance is unstable, the cylindrical base material 1 contacts the entrance of the coating apparatus 10, the cylindrical base material 1 contacts the inner wall surface of the positioning apparatus 20, which are problems, and uneven coating occurs due to vibration caused by the contact. Further, the coating property of the coating solution onto the cylindrical base material is unacceptable, and problems such as dragging or frictional drag occur.

Example 9

(Example and Comparative Example)

The same aluminum drum supporting body as used in Example 1 is also used as the electro-conductive supporting body (cylindrical base material).

As described below, a coating solution component CTL-1 (35 W/V % polymer concentration) is prepared and coated onto the supporting body using the slide hopper type coating apparatus 10 (inner diameter D3=80.5 mm) as shown in FIG. 1. In this case, a positioning apparatus 20 (the length=250 mm, the inner diameter D2), as shown in FIG. 8, is provided just before the coating apparatus 10, and continuous coating is carried out under the condition that the movement rate of the cylindrical base material 1 is 5 mm/sec, and the gap between the coater 11 and the cylindrical base material 1 is 250 μm.

CTL-1 Coating Solution Components

CTM-1 polycarbonate (Z-200, by Mitsubishi Gas Chemical Co.)

1, 2-dichloroethane

The amount of the solid is fixed at the solid weight ratio of CTM-1:Z-200=0.89:1.

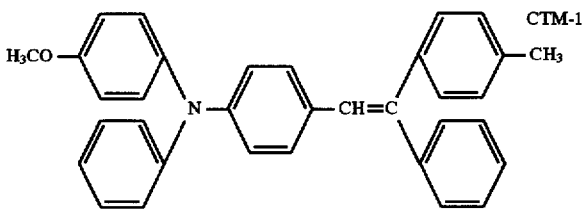

The result of coating is shown in Table 3.

TABLE 3

| Photoreceptor drum No. | 3-1 | 3-2 | 3-3 | 3-4 |
|---|---|---|---|---|
| Outer diameter of supporting body D1 [mm] | 80.00 | 80.00 | 80.00 | 80.00 |
| Inner diameter of coating apparatus [mm] | 80.50 | 80.50 | 80.50 | 80.50 |
| Inner diameter of positioning apparatus D2 [mm] | 80.48 | 80.15 | 80.04 | 80.60 |
| Positioning performance | good | good | good | Unstable. The drum contacts the positioning apparatus wall or the coater. |
| Coating property | good | good | good | Dragging, and frictional drag occur. Uneven coating due to vibration at contact occurs. |

As shown in Table 3, in the present example with respect to photoreceptor drum Nos. 3-1, 3-2, 3-3, the inner diameter D2 of the positioning apparatus 20, and the inner diameter D3 of the coating apparatus 10 have the relationship of D1<D2<D3, and the positioning accuracy is high, no damage nor uneven coating occurs, and coating property is excellent. In contrast to this, in the comparative example of the photoreceptor drum No.3-4 in which the inner diameter D2 and the inner diameter D3 have the relationship of D2>D3, the positioning performance is unstable, the cylindrical base material 1 contacts the entrance of the coating apparatus 10, the cylindrical base material 1 contacts the inner wall surface of the positioning apparatus 20, which are problems, and uneven coating occurs due to vibrations caused by the contact. Further, the coating property of the coating solution onto, the cylindrical base material is unacceptable, and problems such as dragging or frictional drag occur.

Example 10

Figure 10:
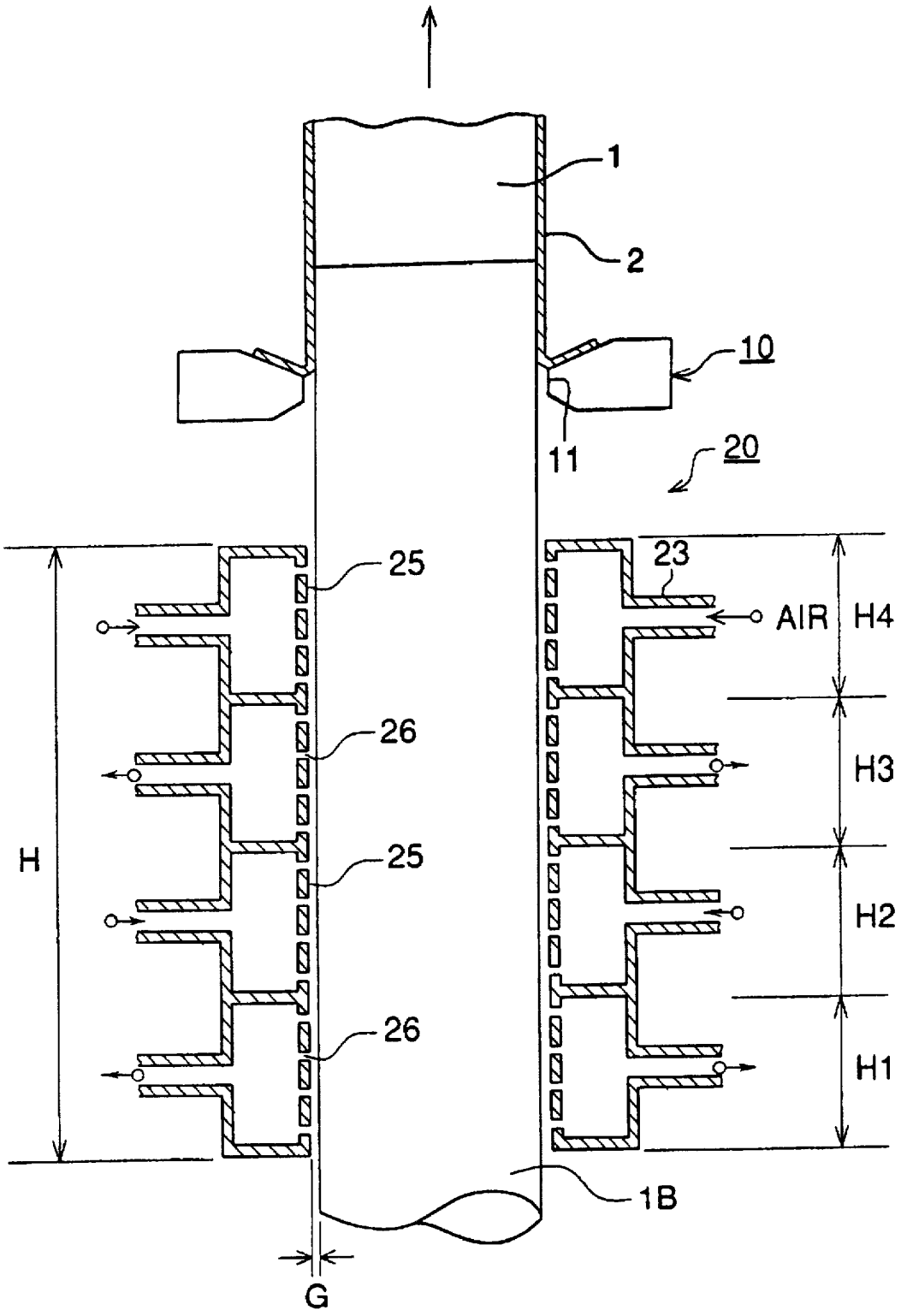
FIG. 10 is an illustrative sectional view of the coating apparatus and the positioning apparatus in Example 10.
Figure 11:
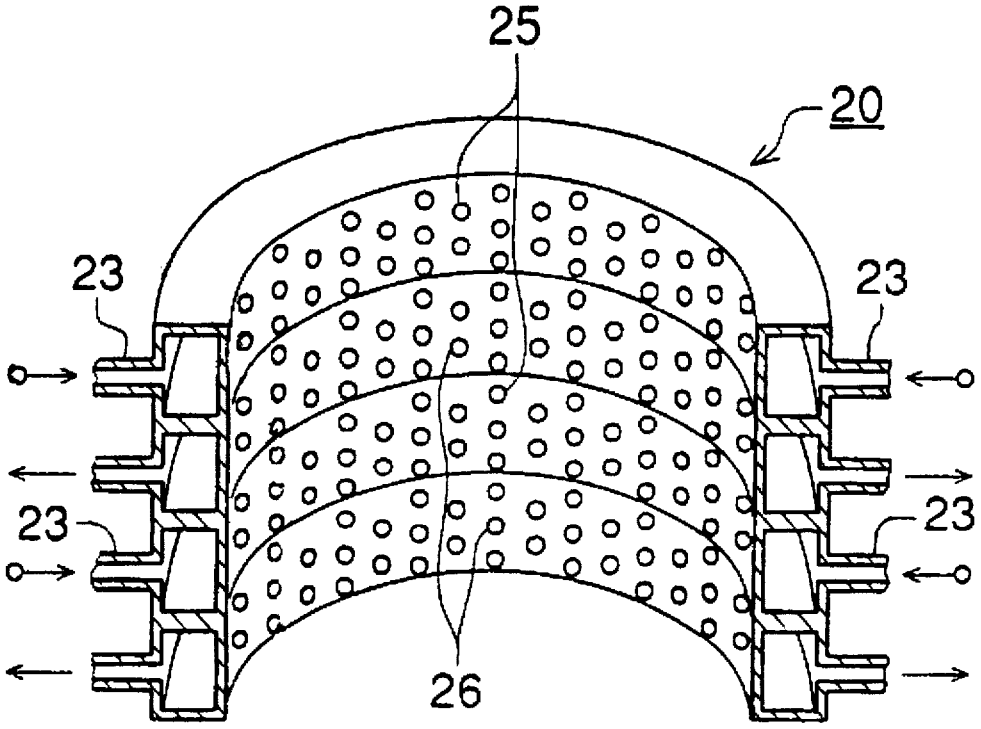
FIG. 11 is a partially fragmentary perspective view showing the positioning apparatus in FIG. 10.

FIG. 10 is an illustrative sectional view showing a coating apparatus 10 and a positioning apparatus 20, and FIG. 11 is a partial fragmentary perspective view showing the positioning apparatus 20 in FIG. 10. In this example, a positioning apparatus 20 (the length H=200 mm, H1–H4=50 mm each, a diameter of each jet opening is 0.3 mm, the diameter of each exhaust port is 2.0 mm), as shown in FIG. 10, is provided just before the coating apparatus 10 such that a jetting device and an exhaust device are alternatingly stacked. When the total area ratio (S ratio) of the jet openings/the exhaust ports is set within the range of 1:1 to 1:300, excellent results can be obtained.

Example 11

Figure 12:
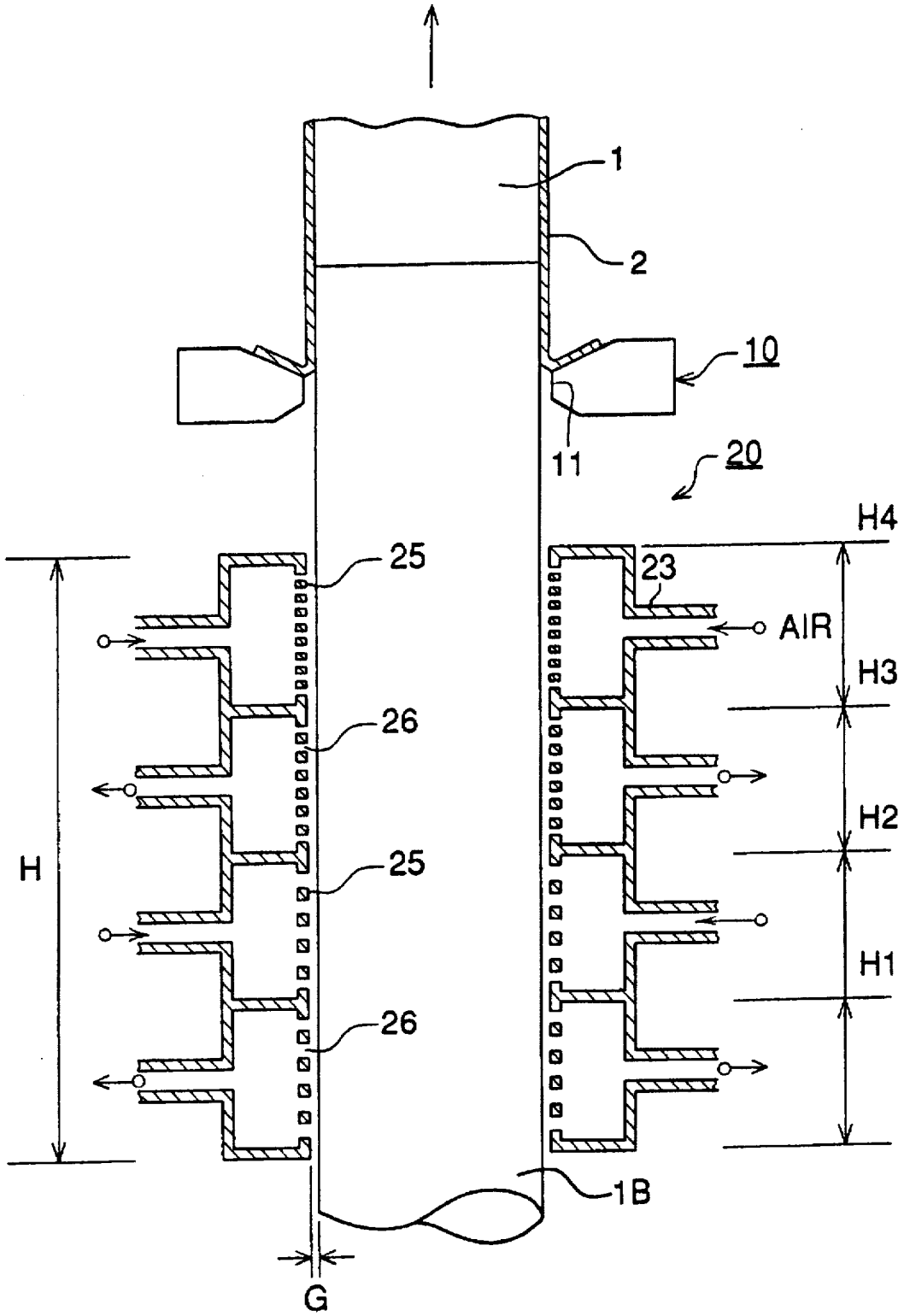
FIG. 12 is an illustrative sectional view showing the positioning apparatus in Example 11.

In this example, the positioning apparatus, shown in FIG. 12, (the length H=240 mm, H1–H4=60 mm each, the diameter of the jet opening is 0.1 mm, the diameter of the exhaust port is 5.0 mm, the number of jet openings per unit area, that is their density, is increased in the H4 portion by 10% of that in the H2 portion. In the same way, in the exhaust ports, the number of ports in the H3 portion is increased by 10% of that of H1 portion.) is provided just before the coating apparatus 10. When the S-ratio is set within a range of 1:1 to 1:300, excellent results, in which variations of the film thickness are small, can be obtained.

Example 12

Figure 13:
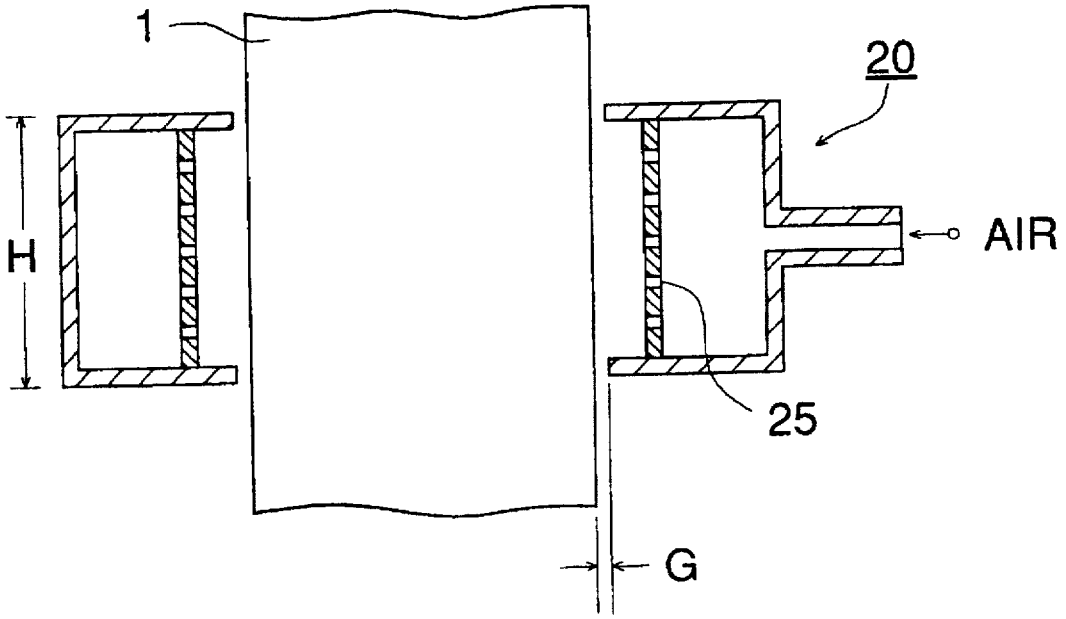
FIG. 13 is an illustrative sectional view of the positioning apparatus in Example 12.

FIG. 13 is a sectional view showing another example of the positioning apparatus 20. In FIG. 13, the jet openings 25 of the positioning apparatus 20 are located at a position slightly separated from the outer peripheral surface of the cylindrical base material 1, and a predetermined gap G is set between the top and bottom portions of both vertical ends in the axial direction of the positioning apparatus main body, and the outer peripheral surface of the cylindrical base body 1.

Example 13

An example of the tapered configuration will now be explained using FIGS. 14(*a*) through 14(*e*).

Figure 14:
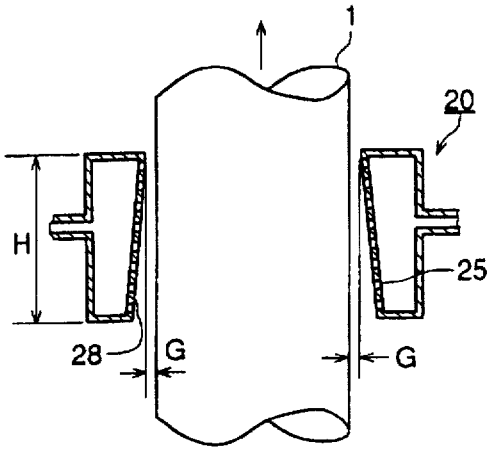
FIGS. 14(*a*), 14(*b*), 14(*c*), 14(*d*) and 14(*e*) are illustrative sectional views showing modifications of the positioning apparatus in Example 13.
Figure 14:
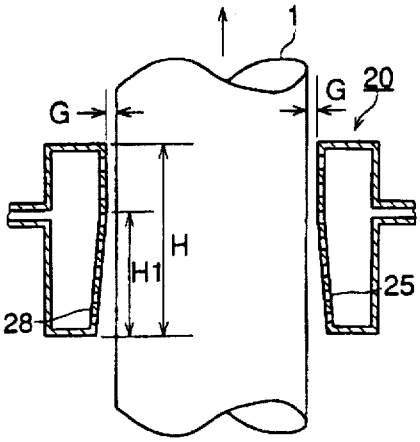
Figure 14:
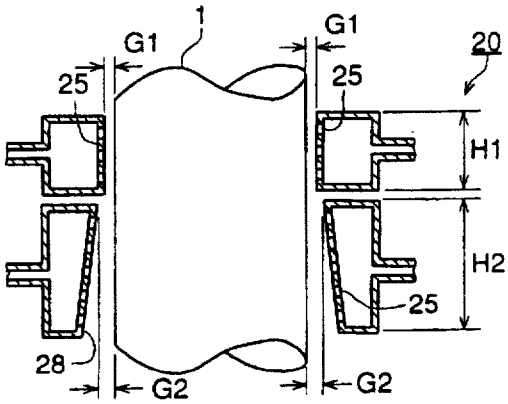
Figure 14:
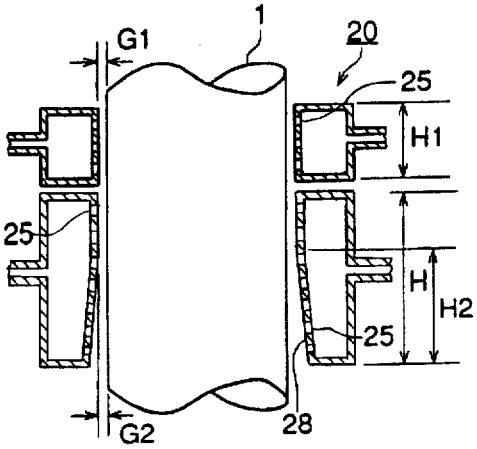
Figure 14:
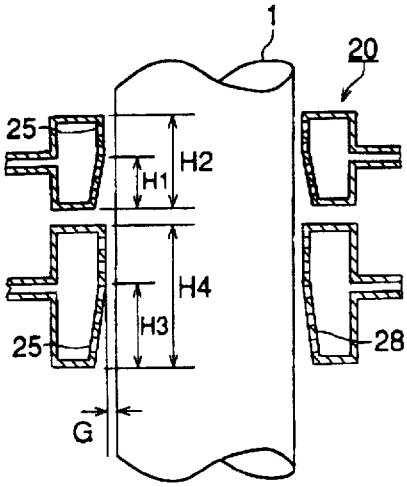
Figure 15:
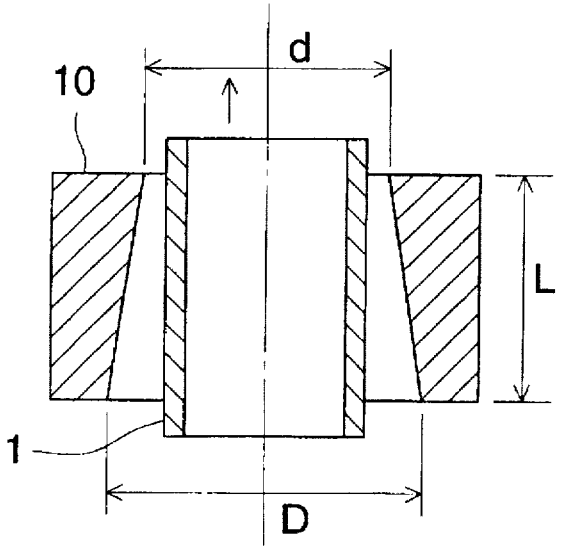
FIG. 15 is a sectional view to explain a tapered surface for ejecting of the positioning apparatus.
Figure 16:
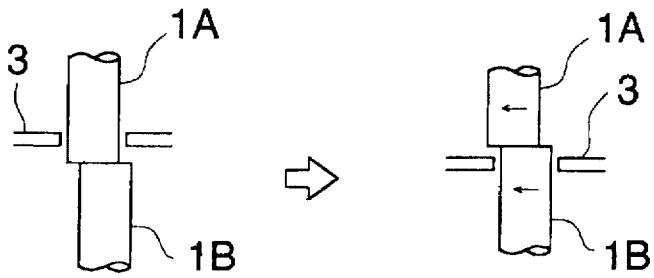
FIGS. 16(*a*) and 16(*b*) are illustrations to explain a condition under which cylindrical base materials are stacked and conveyed.

In FIG. 14(*a*), the surface, having a plurality of jet openings 25, of the positioning apparatus 20 has a taper which narrows in the advancing direction of the cylindrical base body 1, and the minimum gap formed against the outer peripheral surface of the cylindrical base body 1 is G. The taper ratio C means the ratio of the difference (D–d) between diameters of two sections perpendicular to the axial line of the circular cone and the distance (L) between both sections (C=(D−d)/L). FIG. 15 is a sectional view to explain the above taper ratio C. In FIG. 14(*b*), the surface, having the jet openings 25, of the positioning apparatus 20 has the length H1 at the entrance, which tapers to a narrowing diameter in the advancing direction of the cylindrical base material 1. The surface having the jet openings at the exit forms the cylindrical surface having a predetermined gap G with the cylindrical base material 1. The positioning apparatus shown in FIG. 14(*c*), is composed of an upper positioning apparatus provided with a surface having jet openings, the length of which is H1, and which is composed of a cylindrical surface having a gap G1, and the lower positioning apparatus which is provided with the surface having jet openings, the length of which is H2, which is composed of the conical surface (tapered surface) having a minimum gap G2. The positioning apparatus shown in FIG. 14(*d*), is composed of: an upper positioning apparatus provided with the surface having jet openings, the length of which is H1, which is composed of cylindrical surface forming a gap G1; and the lower positioning apparatus, the overall length of which is H, and which is provided with the surface having jet openings which is composed of cylindrical surface forming a gap G2, and the surface having jet openings, which is composed of a conical surface (tapered surface) forming a minimum gap G2, and the length of which is H2.

In FIG. 14(*e*), the positioning apparatus 20 is composed of: the upper positioning apparatus which is composed of jet openings provided on the cylindrical surface and jet openings 25 provided on the tapered surface having an axial length of H1, and an axial length of which is H2; and the lower positioning apparatus which is composed of jet openings 25 provided on the cylindrical surface and jet openings 25 provided on the tapered surface having an axial length of H3, and an axial length of which is H4. In this connection, the minimum gaps G formed between respective surfaces, having jet openings, of the upper and the lower positioning apparatus, and the cylindrical base material 1, are almost equal to each other.

An OPC photoreceptor, on which the photoreceptors of the present invention were successively superimposed in 3 layers of UCL/CGL/CTL, was produced and actually used for copying. As a result, no uneven density, uneven fogging nor image defects (black spots, white spots, streak faults, scratch faults) were observed, and consequently the photoreceptor provided excellent image formation. Further, the coater was not damaged.

The following excellent effects are obtained by methods and apparatus for positioning the cylindrical base material, which are provided in the coating apparatus of the present invention.

(1) Variations in the photoreceptor film thickness coated on the cylindrical base material were negligible.

(2) The coating property of the coating solution onto the cylindrical base material was excellent.

(3) Scratching on the surface of the cylindrical base material was prevented.

(4) The coating solution ejecting portion (coater) of the coating apparatus was also not damaged.

(5) The positioning accuracy of the cylindrical base material was enhanced.

What is claimed is:

1. A method of coating outer surfaces of plural cylinders by a coater having a circular hole on which a coating surface is provided, comprising:

(a) pushing the plural cylinders vertically upward into the circular hole;

(b) coating the outer surface of a cylinder of the plural cylinders by the coating surface while conducting the pushing step;

(c) blowing gas onto the outer surface of the cylinder by a cylindrical blowing device so that the cylinder is positioned coaxially with the circular hole;

the blowing step including a step of changing gas amount when the cylindrical blowing device blows gas onto a joint portion at which a bottom edge of an upper cylinder contacts with a top edge of a lower cylinder; and repeating the steps of (a), (b) and (c) so that the outer surfaces of the plural cylinders are coated sequentially.

2. The method of claim 1, further comprising (d) putting coaxially a new cylinder beneath a lowermost cylinder of the plural cylinders while conducting the pushing step;

(e) removing a coated uppermost cylinder from the plural cylinders; and (f) repeating steps of (a), (b), (c), (d), (e) and (f) so that the coating step is continued for the new cylinder.

3. The method of claim 1, wherein the blowing step includes a step of detecting the joint portion, whereby the gas amount is changed when the joint portion passes the cylindrical blowing device.

4. The method of claim 3, wherein the detecting step is conducted based on a detection signal outputted from a detecting sensor when the detecting sensor detects the joint portion.

5. The method of claim 3, wherein the detecting step is conducted based on a timing signal outputted from a timer when the joint portion passes the cylindrical blowing device.

6. The method of claim 1, wherein the changing step changes a pressure of gas blown from the cylindrical blowing device.

7. The method of claim 1, wherein the coater is a slide hopper coater.

8. The method of claim 1, wherein the cylindrical blowing device has a cylindrical blowing surface on which gas blowing holes are provided, and wherein an inside diameter of the cylindrical blowing surface is smaller than an inside diameter of the coating surface.

9. The method of claim 8, wherein a gap distance between the cylindrical blowing surface and the outer surface of the cylinder is 20 μm to 3 mm.

10. The method of claim 8, wherein blowing gas amount is 0.1 $m^3$/min to 50 $m^3$/min.

11. The method of claim 10, wherein the gas blowing holes are arranged along an upper circle and a lower circle on the cylindrical blowing surface and the blowing gas amount at the upper circle is larger than that at the lower circle.

12. The method of claim 8, wherein the cylindrical blowing surface has a inlet side from which the cylinder is conveyed into the cylindrical blowing device, and the inlet side is tapered.

13. The method of claim 8, wherein the cylindrical blowing surface is provided with exhaust holes, and an area ratio between the gas blowing holes and the exhaust holes is (1:1) to (1:300).

14. The method of claim 13, wherein each gas blowing hole and each exhaust hole is shaped in a circle.

15. The method of claim 14, wherein a diameter of each gas blowing hole is not larger than 1.0 mm.

16. The method of claim 15, wherein a diameter of each exhaust hole is larger than 1.0 mm.

17. The method of claim 13, wherein a number of the gas blowing holes per unit area is changed in an axial direction of the cylindrical blowing surface.

18. The method of claim 13, wherein a number of the exhaust holes per unit area is changed in an axial direction of the cylindrical blowing surface.

19. The method of claim 1, wherein the gas is air having a temperature of 20° C. to 24° C. and a relative humidity of 10% to 65%.

20. An apparatus for coating outer surfaces of plural cylinders, comprising:

a coater having a circular hole on which a coating surface is provided, a pushing device for pushing the plural cylinders vertically upward into the circular hole so that the outer surface of a cylinder of the plural cylinders is coated by the coating surface;

a cylindrical blowing device for blowing gas onto the outer surface of the cylinder so that the cylinder is positioned coaxially with the circular hole; and a control device for changing gas amount when the cylindrical blowing device blows gas onto a joint portion at which a bottom edge of an upper cylinder contacts with a top edge of a lower cylinder.

* * * * *